United States Patent [19]

Mochizuki et al.

[11] 4,331,100

[45] May 25, 1982

[54] MAGNETIC BRUSH DEVELOPMENT APPARATUS

[75] Inventors: Manabu Mochizuki, Yokohama; Masahide Harada, Tokyo; Mitsuo Tanaka, Machida; Kouji Suzuki, Yokohama; Kazuaki Tagawa, Tokyo; Kazuo Kobayashi, Kawasaki, all of Japan

[73] Assignee: Ricoh Company, Ltd., Japan

[21] Appl. No.: 181,051

[22] Filed: Aug. 25, 1980

Related U.S. Application Data

[63] Continuation of Ser. No. 965, Jan. 4, 1979, abandoned.

[51] Int. Cl.[3] ..... G03G 15/09

[52] U.S. Cl. ..... 118/657; 118/658

[58] Field of Search ..... 118/657, 658

[56] References Cited

U.S. PATENT DOCUMENTS 3,064,622 11/1962 Thompson ..... 118/657

*Primary Examiner*—Bernard D. Pianalto

*Attorney, Agent, or Firm*—McGlew and Tuttle

[57] ABSTRACT

A magnetic brush development apparatus includes a developer containing magnetic powder therein which is attracted to a non-magnetic support member by a magnet arranged therein. The developer is brought into contact with a latent electrostatic image bearing member which is located in a development section for developing the latent electrostatic image. The magnet has substantially one magnetic pole portion capable of producing a magnetic field having a plurality of peaks in the intensity of the magnetic field located in the development section.

8 Claims, 21 Drawing Figures

MAGNETIC BRUSH DEVELOPMENT APPARATUS

This is a continuation of application Ser. No. 965 filed Jan. 4, 1979, abandoned.

BACKGROUND OF THE INVENTION

1. Field and of the Invention

The present invention relates to copying or recording devices and in particular to a new and useful magnetic brush development apparatus for use in electrophotographic copying apparatus or electrostatic recording apparatus.

2. Description of the Prior Art

The magnetic brush development apparatus is an apparatus for attracting a developer containing magnetic powder therein to a non-magnetic support member in which magnets are disposed, and for bringing the developer into contact with a latent electrostatic image bearing member at an image development section in order to develop the latent electrostatic image. The name magnetic brush comes from the fact that the developer becomes like a brush on the support due to the magnetic force of the magnets disposed in the non-magnetic support member.

As the developers that can be employed in the magnetic brush development apparatus, there are a two-component type developer comprising non-magnetic toner and magnetic carrier, and a one-component type developer consisting of magnetic toner. The one-component type developer can be classified into an electrically conductive toner and an electrically insulating toner.

Image development is performed by the toner charged to the opposite polarity to that of a latent electrostatic image being electrostatically attracted to the latent electrostatic image. In case of the two-component type developer, the particle size of toner is smaller than that of carrier particles and the toner is triboelectrically charged so that the toner clings to the carrier and a magnetic brush is formed. In the one-component type developer, the electrically conductive toner is charged by injection of charges or by electrostatic induction, while the electrically insulating toner is triboelectrically charged by some member of a developer container with which the toner contacts or during the transporation of the toner.

In case of the two-component type developer, the toner is securely charged, but some means for maintaining the mixing ratio of the toner and the carrier, or the toner concentration, is necessary in order to obtain a developed image of a predetermined image density. In contrast to this, in case of the one-component type developer, it is unnecessary to control the toner concentration, and it is simple to handle the toner although the charging of the toner is not always sufficient.

A sleeve-shaped or cylindrical member and an endless belt-shaped member are known as the non-magnetic supporting members for forming a magnetic brush thereon by attracting the developer thereto. A plurality of magnets arranged in a radial manner and a single rod magnet having magnetic poles on the peripheral surface thereof are known as the magnets to be disposed in the non-magnetic support member. The photoconductor for use in electrophotographic copying apparatus and the dielectric member for use in electrostatic recording apparatus are known as the latent image bearing members. The shapes of the latent image bearing members are drum-like, endless-belt-like, plate-like and sheet-like.

Either, or both of, the non-magnetic support member for holding the magnetic brush thereon and the magnets disposed inside the non-magnetic support member, are moved relative to each other, so that the magnetic brush formed on the non-magnetic support member is moved on the non-magnetic supporting member. The latent image bearing member is also moved at a predetermined speed and the magnetic brush on the non-magnetic supporting member comes in contact with the surface of the latent electrostatic image bearing member at a predetermined position where the non-magnetic support member and the latent electrostatic image bearing member come closest to each other, namely at a development section, so that the latent electrostatic image on the latent image bearing member is developed continuously.

The magnetic brushes on the non-magnetic support member are formed along the lines of magnetic force distributed on the non-magnetic supporting member 1 among the magnets 2, 3, 4 and 5 which are disposed in the non-magnetic support member as shown in FIG. 1. In FIG. 1, the distribution of the magnetic lines of force among only the magnetic 2, 3 and 4 are shown. Each line of magnetic force starts from the magnetic pole N and returns to the magnetic pole S, and the magnetic field is strongest at each magnetic pole. The magnetic brush becomes highest at each magnetic pole and lowest inbetween each pole. The magnetic brush stands out at each magnetic pole as shown by reference number 6 in FIG. 2. Therefore, normally, the magnets are arranged so that each magnetic pole of the magnets is located in the development section and development is performed by the highest portion of the magnetic brush.

Generally, the image density of developed image depends upon development time. The development time here means a period of time in which developer is in contact with a latent electrostatic image bearing member. Therefore, in the magnetic brush development apparatus, the development time is a period of time in which the magnetic brush is in contact with a latent electrostatic image bearing member at the development position.

As mentioned previously, since the latent image bearing member is moved at a predetermined speed, the period of time in which the magnetic brush is in contact with the latent image bearing member is related to the width w of the magnetic brush in contact with the latent image bearing member. Therefore, the development efficiency, namely the image density of developed image per unit time can be increased by broadening the contact width w.

As one of the conventional techniques for making the contact width w great, an apparatus is known in which plural non-magnetic support members for supporting the magnetic brush thereon are disposed in close proximity to the surface of a latent electrostatic image bearing member, whereby the contact width w can be substantially increased. However, this apparatus has some shortcomings that the apparatus is oversized and expensive. In order to eliminate such shortcomings, it is necessary to increase the contact width w by a single non-magnetic supporting member.

In the magnetic brush development apparatus as shown in FIG. 2, the contact width w of the magnetic brush is related to a gap d in the development section between a latent electrostatic bearing member 7 and a non-magnetic support member 1, since the magnetic brush stands out at each magnetic pole. The contact width w is greater in the bottom portion of the magnetic brush than in the top portion of the magnetic brush. Therefore, the smaller the gap d, the greater the contact width w.

However, there is a limit in reducing the gap d, since the smaller the gap d, the greater pressure the toner receives at the gap d, so that blocking of the toner occurs by the toner being solidified under the pressure. When blocking of the toner occurs, the solidified toner scratches the latent electrostatic image or the surface of the latent image bearing member. Therefore, in order to increase the development efficiency, it is important to reduce the gap d to the extent that blocking of the toner does not occur.

Since the gap d is related to the contact width w and accordingly to the development time, images with an uneven image density are formed when the gap d changes during development. In the conventional magnetic brush development apparatus, a spacer roller is disposed between a non-magnetic sleeve and a photoconductor in order to maintain a minimum gap d.

However, as mentioned previously, since there is a limit in increasing the development efficiency by reducing the gap d, it is necessary to increase the contact width w by some other method for raising the development efficiency. Furthermore, it is known that the image density is not varied when the contact width w is large enough even if the gap d is changed to some extent. Therefore, it is more advantageous to increase the contact width w by some method.

As another method of increasing the contact width w, there is proposed a method of increasing the width of the magnet in the development section. However, the larger the magnet, the greater the magnetic flux density and the stronger the magnetic brush, which may cause a risk of disturbing the latent image on the photoconductor when the surface of the photoconductor is brushed by the strong magnetic brush.

As a further method of increasing the contact width w, there is known a method of disposing two magnets 8 and 9 with s space therebetween and with their magnetic poles arranged in the same direction in the development section as shown in FIG. 3. In this method, a magnetic field is formed so as to have a peak of magnetic field intensity right above the two magnets 8 and 9, so that the contact width w of the magnetic brush 6 with the photoconductor 7 is increased in comparison with the conventional magnetic brush development apparatus as shown in FIG. 4. However, this method has the following shortcomings in comparison with the above-mentioned conventional methods. Namely, more magnets are necessary, and the assembling of the apparatus is more difficult. And since the magnetic fields of the two magnets are directed oppositely at locations the two magnets, the magnetic toner or the magnetic carrier existing on the portion above the space between the two magnets is magnetized in the polarity opposite to that of the magnetic toner or the magnetic carrier in the other portion, so that the chainlike arrangement of the toner or the carrier is interrupted by the two magnets. The oppositely directed magnetic fields of the two magnets 8 and 9 are illustrated in FIG. 5, in which the lines of magnetic force starting from the N pole are directed to the N pole in the respective magnets 8 and 9, so that the lines of magnetic force starting from the respective N poles are oppositely directed.

In the magnetic brush development process of a magnetic brush development apparatus, the development force can be represented by the following formula:

$$F = Fc - F_M$$

where F represents the development force, and Fc represents the electrostatic attraction of a photoconductor for attracting the developer thereto, and $F_M$ represents the magnetic attraction for attracting the developer magnetically in the magnetic brush development apparatus.

From the above formula, it can be seen that the magnetic attraction $F_M$ serves as a negative bias with respect to the development force in the magnetic brush development apparatus. Referring to FIG. 14, there is shown a development characteristic of the magnetic brush development by employing the magnetic attraction $F_M$ as a parameter, with the amount of toner deposition M as ordinate and surface charge Q of a photoconductor as abscissa. The solid line indicates a development characteristic when the magnetic attraction $F_M$ is comparatively small, while the broken line indicates a development characteristic when the magnetic attraction $F_M$ is comparatively great. In either case, the development time is set constant. As can be seen from FIG. 14, when the magnetic attraction $F_M$ is small, the toner deposition begins to be saturated even if the surface charge Q is comparatively small. Accordingly, uneven development hardly occurs. Furthermore, when the magnetic attraction $F_M$ is set small, the amount of toner deposition M during a predetermined development time becomes greater than that in case the magnetic attraction $F_M$ is set great and accordingly, the development time can be shortened in comparison with that in case of a freat magnetic attraction $F_M$ when an equal amount of toner deposition is required. However, when the magnetic attraction $F_M$ is set small, background appears in the copy and sharpness of image is lowered, so that setting the magnetic attraction $F_M$ at a low level has an adverse effect on the image quality.

SUMMARY OF THE INVENTION

It is therefore an object of the present invention to provide a magnetic brush development apparatus capable of eliminating the above-mentioned shortcomings of the conventional magnetic brush development apparatus. In the magnetic brush development apparatus according to the present invention, a magnet disposed in a non-magnetic support member can generate a magnetic field having plural peaks in the distribution of the intensity of the magnetic field and has a substantially one magnetic pole portion in the development section.

Another object of the invention is to provide a magnetic brush development apparatus having an excellent development efficiency with uneven development obviated by broadening the width of a magnetic brush which is in contact with a latent electrostatic image bearing member.

A further object of the invention is to provide a magnetic brush development apparatus whose construction is simple and which can be assembled easily.

According to the present invention, in a magnetic brush development apparatus having a non-magnetic sleeve and a magnet disposed inside the non-magnetic sleeve for producing a magnetic field on the outer peripheral surface of the non-magnetic sleeve, the magnet has substantially one magnetic pole portion capable of producing a magnetic field having plural peaks in the intensity of the magnetic field with the peaks being located upstream of the movement of a latent electrostatic image bearing photoconductor.

DETAILED DESCRIPTION OF THE PREFERRED EMBODIMENTS

Figure 1:
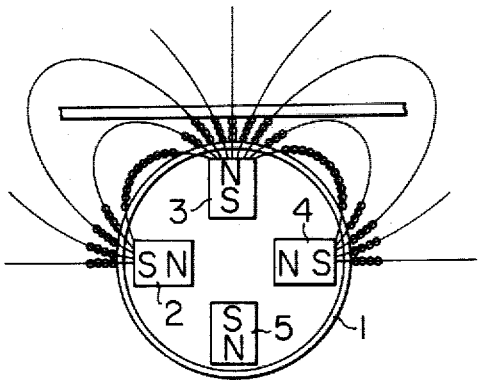
FIG. 1 PRIOR ART
FIG. 1 is a schematic microscopic sectional view of the formation of a magnetic brush in a conventional magnetic brush development apparatus.
Figure 2:
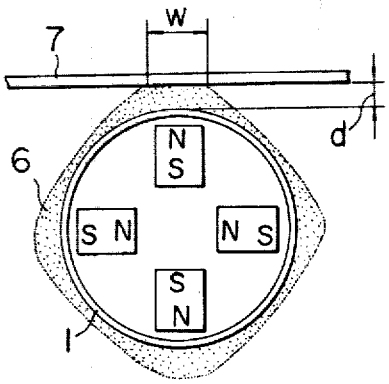
FIG. 2 PRIOR ART
FIG. 2 is a schematic macroscopic sectional view of the magnetic brush of FIG. 1.
Figure 3:
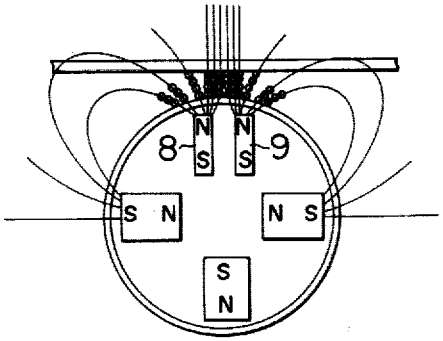
FIG. 3 PRIOR ART
FIG. 3 is a schematic microscopic sectional view of the formation of a magnetic brush in another conventional magnetic brush development apparatus.
Figure 4:
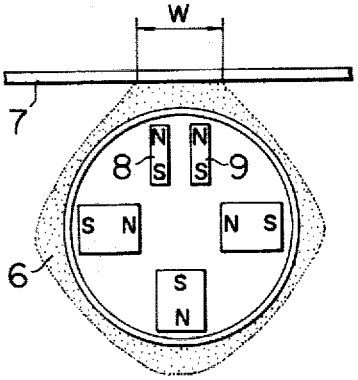
FIG. 4 PRIOR ART
FIG. 4 is a schematic macroscopic sectional view of the magnetic brush of FIG. 3.
Figure 5:
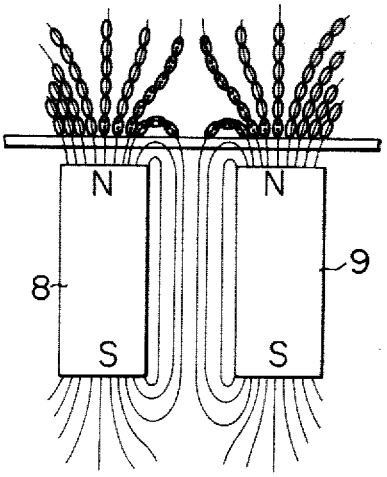
FIG. 5 is a partially enlarged view of the magnetic brush of FIG. 3.
Figure 6:
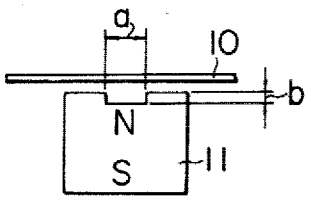
FIG. 6 is a schematic sectional view of a magnet for the present invention.
Figure 7:
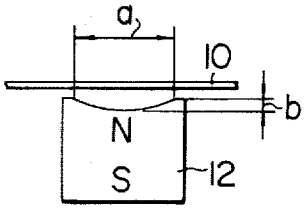
FIG. 7 is a schematic sectional view of another magnet for the present invention.
Figure 8:
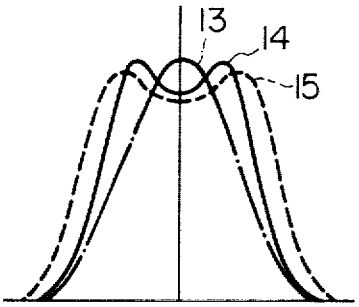
FIG. 8 shows the distribution of the intensity of magnetic field of each of the magnets of the present invention compared with that of a conventional magnet.

Referring to FIG. 6, there is shown a magnet for one embodiment of a magnetic brush development apparatus of the present invention. In FIG. 6, a magnet 11 having a flat concave portion in the central portion of the magnet 11 is disposed under a non-magnetic supporting element 10. The opposite end portions of the magnet 11 project toward the supporting element 10. Referring to FIG. 7, a magnet 12 has a curved concave portion in the central portion thereof and accordingly the opposite end portions of the magnet 12 are projected towards the non-magnetic supporting element 10. The distribution of the intensity of magnetic field of the magnets having a concave portion in the central portion thereof is shown in FIG. 8. In FIG. 8, the long and short dash line 13 indicates the distribution of the intensity of magnetic field of a conventional flat magnet, which has one peak of the intensity of magnetic field, while the solid line 14 indicates the distribution of the intensity of the magnetic field of the magnets of the present invention, which has two peaks of the intensity of the magnetic field. The shape of the curve having two peaks of the intensity of the magnetic field depends upon the size of the concave portion formed in the magnet. Namely, when the width a of the concave portion of the magnet is constant and the depth b of the concave portion is changed, the greater the depth b, the greater central dropping of the curve of the intensity of magnetic field; and when the depth b is constant and width a changes, the greater the width a, the lower the two peaks. If the ratio a:b is 4:1, the distribution of the intensity of magnetic field is shown by the solid line 14 and, if the ratio a:b is 4:2, the distribution of the intensity of magnetic field is shown by a broken line 15.

Figure 9:
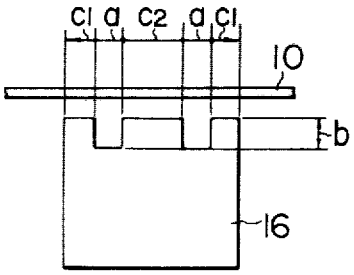
FIG. 9 is a schematic sectional view of a further magnet for the present invention.
Figure 10:
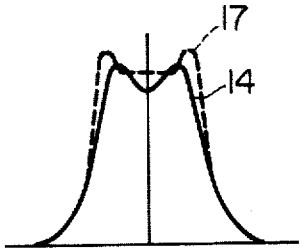
FIG. 10 shows the distribution of the intensity of the magnetic field produced by the magnet of FIG. 9.

In the above-mentioned examples of the magnets, only one concave portion is formed in each magnet. However, plural concave portions can be formed in one magnet, so that the distribution of the intensity of magnetic field can be changed. For example, referring to FIG. 9, there is shown a magnet 16 which has two concave or recessed portions, each of which has a width a and a depth b. When the width of the opposite bank-like portions of the magnet 16 is $C_1$ and that of the central bank-like portion of the magnet 16 is $C_2$ and the two concave portions and the bank-like portions are formed with the size ratio of $a:b:C_1:C_2$ being 2:2:2:4, the distribution of the intensity of magnetic field becomes like a curve indicated by the broken line 17 in FIG. 10. As can be seen from FIG. 10, in contrast to the distribution of the intensity of magnetic field of the magnet having one concave portion, the curve of the distribution of the intensity of magnetic field is a broad curve having a small and uniform central dropped portion. Furthermore, by changing the shape of the magnet, the distribution of the intensity of magnetic field of the magnet can be changed so as to have three or more peaks. Thus, according to the invention, a different distribution of the intensity of magnetic force can be formed on the non-magnetic support member by changing the shape of the magnet.

Figure 11:
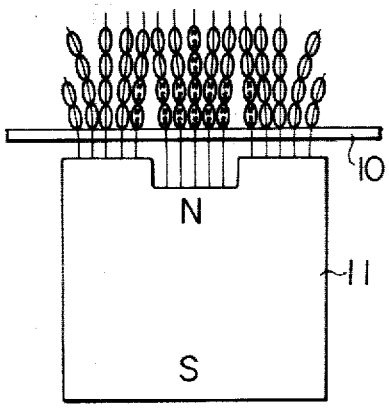
FIG. 11 is a schematic enlarged sectional view of the formation of the magnetic brush according to the present invention.

The magnets for the present invention can be made by various methods. The simplest method is to mold a ferromagnetic material and magnetize it and from a concave portion in the thus made magnet as desired by a diamond cutter. Another method is to form a desired concave portion in a ferromagnetic material first and to magnetize it later. A further method is to join together magnets or cause a ferromagnetic material to adhere to the projecting portions of a magnet. In the above-mentioned examples, the magnets are composed of pieces of magnets. However, one magnetic rod with predetermined concave portions at desired magnetic pole portions can be used as well. In any of the magnets according to the invention, since the lines of magnetic force generated from its N pole are distributed perpendicularly to and all over the non-magnetic support member 10, the magnetic toner or the magnetic carrier on the non-magnetic support member is magnetized uniformly in the same direction as shown in FIG. 11, so that a stable magnetic brush is formed on the non-magnetic support member.

Figure 12:
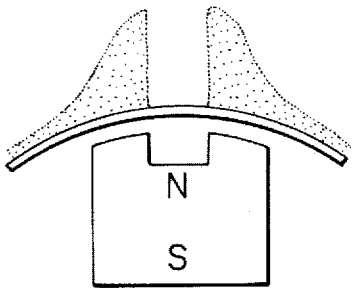
FIG. 12 is a schematic macroscopic sectional view of the magnetic brush of the present invention as when the magnetic brush is stationary.
Figure 13:
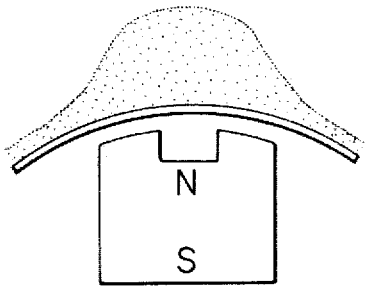
FIG. 13 is a schematic macroscopic sectional view of the magnetic brush of FIG. 12 as when the magnetic brush is moved.
Figure 14:
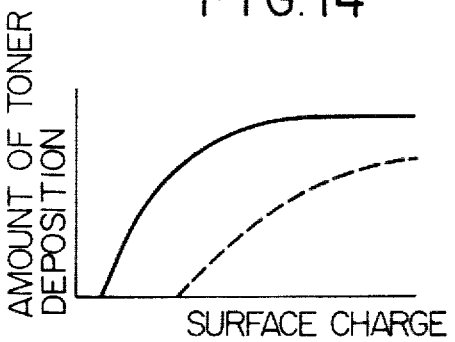
FIG. 14 is a graph of a development characteristic of a magnetic brush development apparatus by use of the magnetic attraction as a parameter.

The magnetic brush of the invention is gently sloping at the magnetic pole portions when the non-magnetic support member 10 and the magnet 11 are stopped. However, when the intensity of the magnetic force is distributed with a peak in each end portion, the magnetic brush is divided into two as shown in FIG. 12 by a slight shock due to the gradient force of the magnetic field gradient. However, the two divided magnetic brushes are made into one magnetic brush as the non-magnetic support member 10 or the magnet 11 is moved since the variation of the magnetic field intensity is continuously effected over the magnetic toner or the magnetic carrier on the non-magnetic support member as shown in FIG. 13. The thus formed magnetic brush has a small toner density and the blocking of the toner does not occur when the development gap is narrowed.

Figure 15:
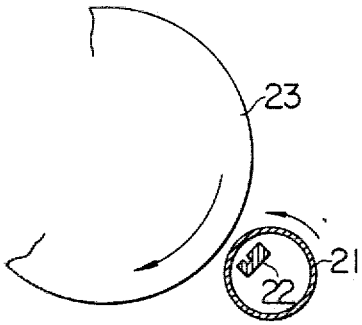
FIG. 15 is a schematic sectional view of a further embodiment of the present invention.

Referring to FIG. 15, there is schematically shown a further magnetic brush development apparatus of the invention. In FIG. 15, reference numeral 21 represents a non-magnetic sleeve which is rotated counterclockwise. In the non-magnetic sleeve 21, there is disposed a magnet 22. Part of the non-magnetic sleeve 21 faces a drum-shaped latent electrostatic image bearing member or a photoconductor drum 23 with a predetermined space therebetween. The magnet 22 has a magnetic pole, for instance, an N pole, facing the surface of the photoconductor drum 23 through the non-magnetic sleeve 21 in a development station, so that a magnetic field is formed in the development section on the non-magnetic sleeve 21. A magnet (not shown) for transporting developer is incorporated in the non-magnetic sleeve 21. As is enlarged in FIG. 16, in the magnetic pole portion of the magnet 22, there is formed a groove 24 which is eccentrically located closer to the surface of the photoconductor drum 23. Viewed from the rotating direction of the photoconductor drum 23, a first magnetic pole portion 25 is formed in the magnet 22, upstream of the groove 24, and a second magnetic portion 26 is formed downstream of the groove 24. The first magnetic portion 25 is broader than the second magnetic portion 26.

Figure 17:
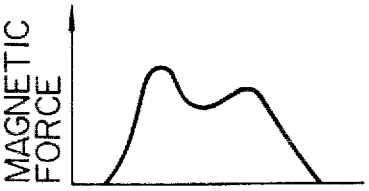
FIG. 17 is a graph showing the distribution of the intensity of magnetic field on the surface of a non-magnetic sleeve in which the magnet of FIG. 15 is employed.

In this case, due to the groove 24 formed in the magnetic pole portion of the magnet 22, a magnetic field having two peaks in the distribution of the intensity of the magnetic field is obtained, and magnetic flux density of the second magnetic pole portion 26 is higher than that of the first magnetic pole portion 25 as can be seen from the distribution of the magnetic force on the non-magnetic sleeve 21 in FIG. 17.

Therefore, in developing a latent electrostatic image on the photoconductor drum 23, firstly the developer is deposited uniformly on the latent electrostatic image by the comparatively weak magnetic field produced by the first magnetic pole portion 25 which is located upstream in view of the rotation of the photoconductor drum 23, and secondly the latent electrostatic image is completely developed by comparatively strong magnetic field produced by the second magnetic pole portion 26 which is located downstream of the first magnetic pole portion 25, whereby a high quality image with a uniform image density and without background can be obtained.

Figure 18:
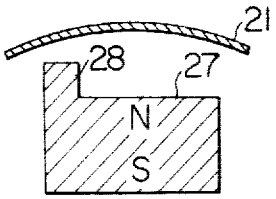
FIG. 18 is an enlarged schematic sectional view of a main portion of a further embodiment of a magnetic brush development apparatus of the present invention.

In FIG. 18, there is shown partially enlarged schematic sectional view of a further embodiment of the present invention. In FIG. 18, in the magnetic pole portion of the magnet, there is formed a first magnetic pole portion 27 which is formed with a predetermined first space away from the outer peripheral surface of the non-magnetic sleeve 21, and a second magnetic pole portion 28 with a second space away from the outer peripheral surface of the non-magnetic sleeve 21. The first space is greater than the second space, so that the second magnetic pole portion 28 constitutes a stepped end portion of the magnetic pole portion of FIG. 18. In this case, the first magnetic pole portion 27 is located upstream of the second magnetic pole portion 28, viewed from the rotation of the photoconductor drum 23.

Figure 16:
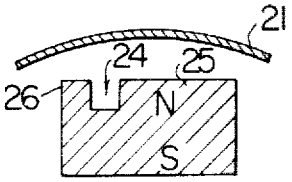
FIG. 16 is an enlarged schematic sectional view of a main portion of the magnetic brush development apparatus of FIG. 15.
Figure 19:
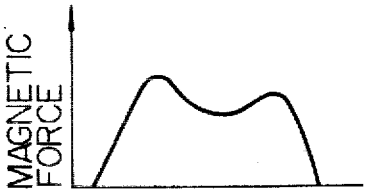
FIG. 19 is a graph showing the distribution of the intensity of magnetic field on the surface of a non-magnetic sleeve in which the magnet of FIG. 18 is employed.

In this embodiment, the intensity of the magnetic field is distributed as shown in FIG. 19, so that the effect similar to that of the embodiment of FIG. 16 can be obtained.

Figure 20:
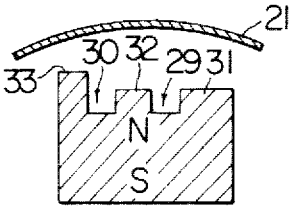
FIG. 20 is an enlarged schematic sectional view of a main portion of a still further embodiment of the present invention.
Figure 21:
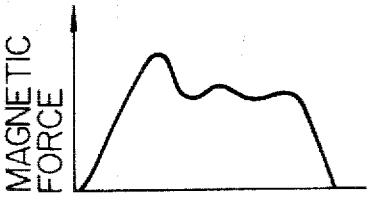
FIG. 21 is a graph showing the distribution of the intensity of magnetic field on the surface of a non-magnetic sleeve in which the magnet of FIG. 20 is employed.

In FIG. 20, there is shown partially an enlarged schematic sectional view of a still further embodiment of the invention. In the magnetic pole portion of the magnet of this embodiment, there are formed two grooves 39 and 30 which are spaced away from each other, and a first magnetic pole portion 31, a second magnetic pole portion 32, and a third magnetic pole portion 33 which are separated by the two grooves 39 and 30. Of the three magnetic pole portions 31, 32 and 39, the first magnetic pole portion 31 and the second magnetic pole portion 32, which are located upstream of the third magnetic pole portion 33, are equally spaced away from the outer peripheral surface of the non-magnetic sleeve 21, while the third magnetic pole portion 33 is located closer to the non-magnetic sleeve 21 than the first two magnetic pole portions 31 and 32. In this embodiment, the curve of the intensity of the magnetic field has three peaks as shown in FIG. 21. Of the three peaks of the intensity of the magnetic field, the peak existing most downstream of the rotation of the photoconductor drum 23 is the highest, which indicates the greatest magnetic force. In this embodiment, the developer is deposited uniformly on a latent electrostatic image on the photoconductor drum 23 by the comparatively weak magnetic field of the first magnetic pole portion 31 and the second magnetic pole portion 32 and the latent electrostatic image is then completely developed by the comparatively strong magnetic field produced by the third magnetic pole portion 33.

What is claimed is:

1. In a magnetic brush development apparatus for use with copying or recording devices having a latent image-bearing member and a non-magnetic support for holding a magnetic brush of developer and wherein the support and the image-bearing member are movable relative to each other for brushing the developer over a latent image, the improvement comprising magnetic means disposed adjacent said non-magnetic support and acting on the magnetic brush thereon and producing a magnetic field with a plurality of peaks of intensity acting on the magnetic brush so as to form the brush with peaks of developer along the width of the non-magnetic support, which brush contact the latent image-bearing member, said magnetic means comprises a single one-piece magnet having one pole adjacent said support, said one pole having a brush forming surface at the top thereof facing said support which includes an inwardly recessed portion relative to said support, flanked by flanking portions of said surface extending outwardly toward said support relative to said recess portion, said magnet having another pole spaced away from said support.

2. In an apparatus according to claim 1, wherein said recessed and flanking portion of said surface together form a concave recess between the ends of said surface.

3. In an apparatus according to claim 1, including a plurality of said recessed portion between a plurality of said flanking portions.

4. In an apparatus according to claim 1, wherein said recessed portion is rectangular in shape and said flanking portions are rectangular in shape.

5. In an apparatus according to claim 1, wherein one of said flanking portions comprises a narrow projection and the other of said flanking portions comprises a wider projection across said surface which precedes said narrow projection in a direction of movement of said image-bearing member.

6. In an apparatus according to claim 5, including one additional recessed portion in said wider projection.

7. In an apparatus according to claim 1, wherein said recess portion is rectangular in shape and said flanking portions are curved in shape corresponding to an inner curvature of said non-magnetic support.

8. In an apparatus according to claim 1, wherein one of said flanking portions on one end of said surface extends outwardly further than the other of said flanking portions.

* * * * *